United States Patent [19]

Clowe

[11] Patent Number: 4,565,596

[45] Date of Patent: Jan. 21, 1986

[54] TAPERED CONTAINER LABELING APPARATUS AND METHOD

[76] Inventor: Henry W. Clowe, 3600 Old Canton Rd., Jackson, Miss. 39216

[21] Appl. No.: 673,366

[22] Filed: Nov. 20, 1984

[51] Int. Cl.[4] ..... B65C 3/16; B65C 9/04

[52] U.S. Cl. ..... 156/215; 156/451; 156/453; 156/564; 156/573; 156/578; 156/DIG. 13; 156/DIG. 26; 156/DIG. 34

[58] Field of Search ..... 156/215, 451, 453, 564, 156/573, 578, DIG. 13, DIG. 26, DIG. 29, DIG. 34

[56] References Cited

U.S. PATENT DOCUMENTS

| | | | |
|---|---|---|---|
| 3,179,548 | 4/1965 | Debray | 156/451 |
| 3,215,582 | 11/1965 | Carter | 156/564 |
| 3,915,338 | 10/1975 | Kronseder et al. | 156/DIG. 29 |
| 4,443,285 | 4/1984 | Roth et al. | 156/564 |
| 4,455,182 | 6/1984 | Roth et al. | 156/564 |

*Primary Examiner*—Michael Wityshyn
*Attorney, Agent, or Firm*—B. P. Fishburne, Jr.

[57] ABSTRACT

Upwardly conically tapered containers having glue on their peripheries are conveyed horizontally in succession through a labeling station while being rotated on their vertical axes. A stack of curved labels having their longer edges arranged lowermost at the labeling station receive constant forward pressure applied to the rear of the stack while the forward end of the stack is being engaged and held by a system of top and bottom adjustable knives which establish a twisted configuration to the labels in the stack. The arrangement allows each leading label in the stack to be taken therefrom by a rotating tapered container and to be applied to the tapered periphery of the container with the leading and trailing ends of the label substantially perfectly aligned and registered. A range of container sizes having varying degrees of taper can be accommodated by the labeling apparatus.

13 Claims, 21 Drawing Figures

FIG. 1
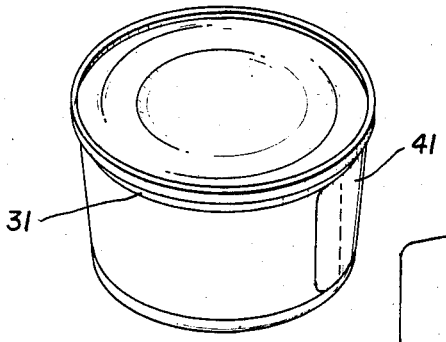
FIG. 2
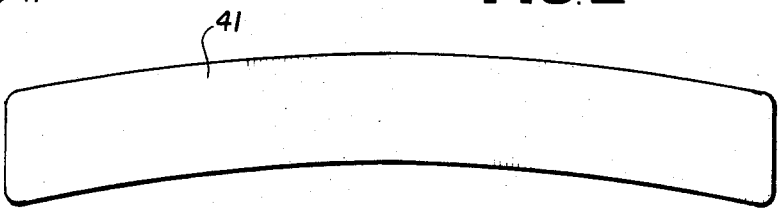
FIG. 3
PRIOR ART
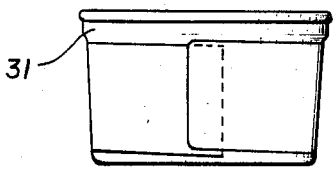
FIG. 5
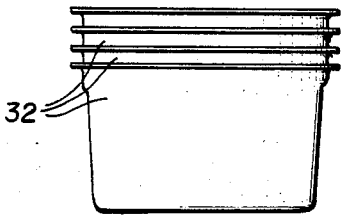
FIG. 4
PRIOR ART
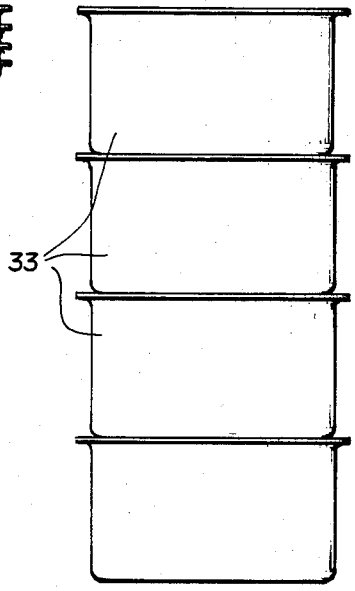
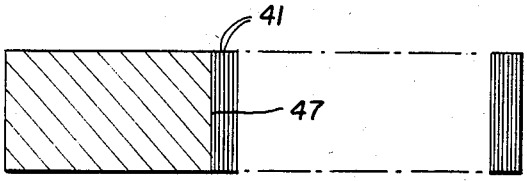
FIG. 15
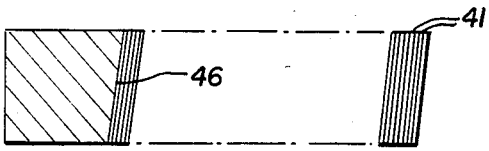
FIG. 16
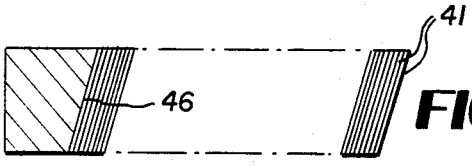
FIG. 17
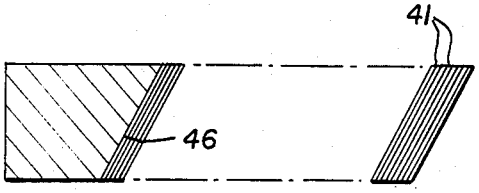
FIG. 18
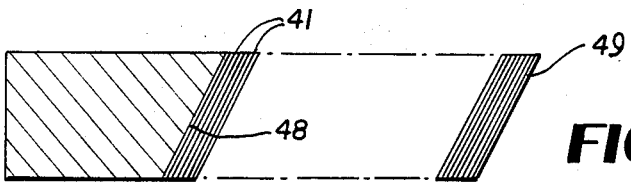
FIG. 19
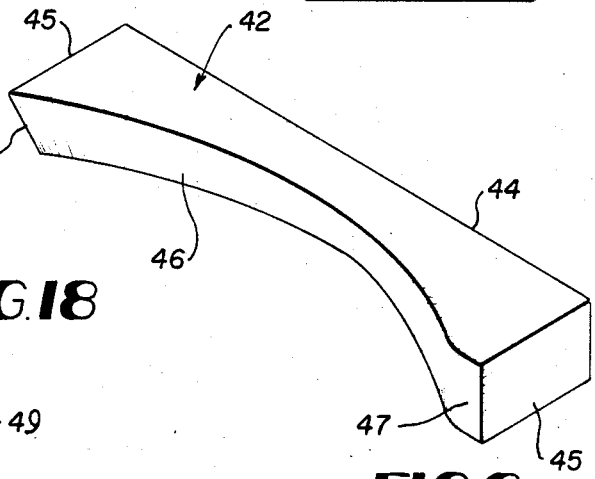
FIG. 6

THE PROBLEM

FIG.11
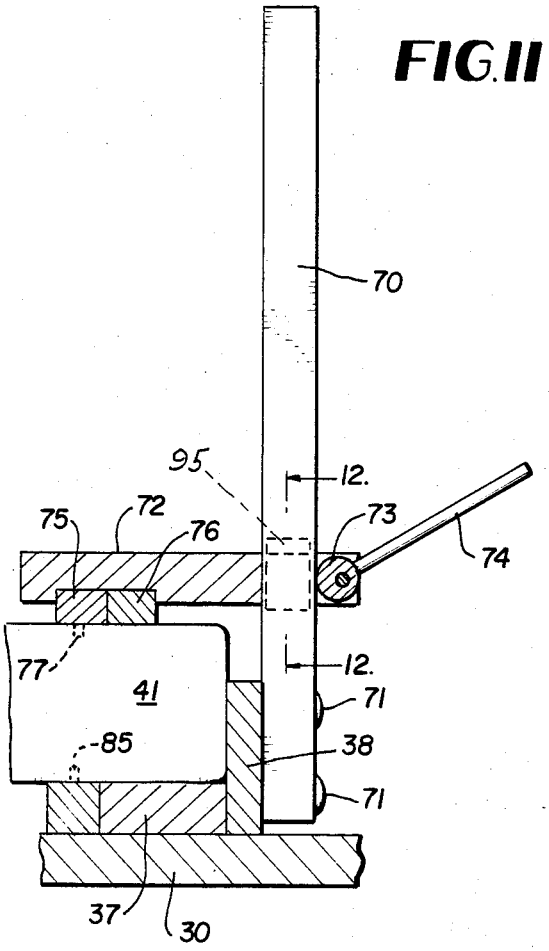
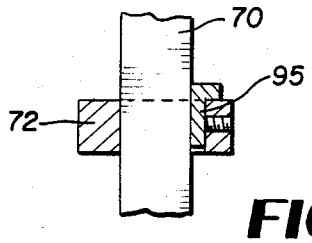
FIG.12
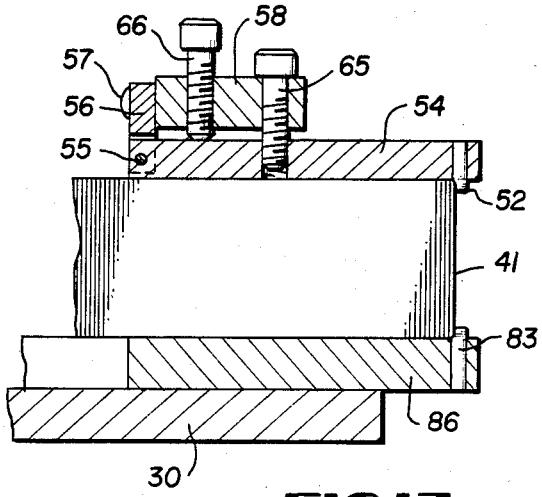
FIG.13
FIG.14
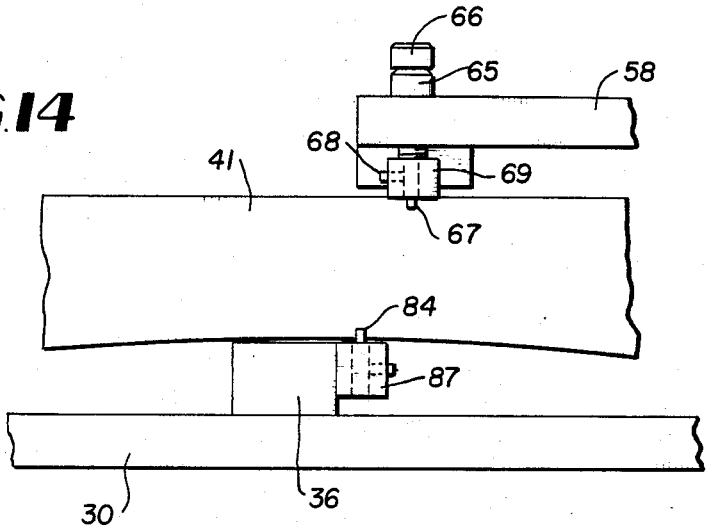

TAPERED CONTAINER LABELING APPARATUS AND METHOD

BACKGROUND OF THE INVENTION

The use of tapered containers in the canning industry has always been desirable, although tapered cans have not been widely used. An important advantage of tapered cans over straight cylindrical cans is the ready nestability of the former enabling compact storage of can bodies with stability in a much smaller storage area. Cylindrical can bodies not only resist nesting but cannot be stacked with any degree of stability, and therefore require a much greater storage area. The daily shopper in the supermarket is also very familiar with the tendency of stacked cylindrical canned goods to tumble and scatter on shelves. Conically tapered containers are much more readily stackable with stability on store shelves due to the fact that the smaller diameter container bottoms will stack and nest nicely on the larger diameter tops of containers below.

In spite of these advantages present in tapered containers, certain drawbacks in their commercial usage has prevented them from being widely adopted, as stated. Chief among these drawbacks is the much greater difficulty in applying labels to the conically tapered walls of tapered cans or other containers. Tapered containers require the use of curved labels in which one edge of the label must be somewhat longer than the other edge to match the two different circumferences of the container near its opposite ends. On a production basis utilizing high speed labeling machinery, it has not proven to be possible to apply labels to tapered cans and the like with the necessary consistency in terms of good final appearance demanded in the industry. The main problem which has not been solved is that of obtaining good alignment or registration of the two ends of a curved label being applied to the periphery of a tapered can. Misalignment of the label ends seems to inevitably result in the prior art, and good-appearing labels are so important that there is a major reluctance to use tapered can bodies in the industry.

Attempts have been made to deal with the problem in the prior art, and U.S. Pat. No. 3,915,338 is one example. In this patent, curved labels for use on tapering container bodies or necks are held within a special arcuate tray carrier. The stacked labels in the curved carrier are disposed vertically on edge within the labeling apparatus. The labels are also held within the stack in a flat non-twisted configuration. As a result, the patented method and apparatus simply has not given the results hoped for in terms of applying labels to tapered containers with the necessary accuracy and consistency. Therefore the need for this accomplishment still exists and still remains unsatisfied in the art. Accordingly, it is the objective of the present invention to completely satisfy this need through the provision of a highly efficient and reliable production apparatus and method for labeling tapered cans and the like.

The essence of the present invention resides in positioning and configuring the curved labels at a container labeling station in such a manner that oncoming rotating tapered cans having glue applied to their peripheries will each in succession pick up a leading label from a stack and cause the label to be wrapped around the tapered wall of the can with the leading and trailing ends of each label in precise registration.

More particularly, in the present invention, the labels are held in a longitudinally twisted form in the labeling apparatus. The leading ends of the labels which are initially engaged by oncoming containers are vertically disposed and the trailing ends of the labels are inclined so that their top edges project forwardly of their bottom edges. The label inclination angle progressively increases from the vertical leading end to the trailing forwardly inclined end. The labels are also held in a curved state between their leading and trailing ends so that their intermediate portions are disposed rearwardly from the label ends. This particular label configuration is critical and necessary to achieve on a production basis the desired results in terms of precise and consistent labeling of tapered cans and the like. The required configuring and holding of the labels within the labeling apparatus is achieved by using a contoured pusher block behind the label stack in conjunction with a system of top and bottom edge adjustable knives at the front of the stack which shape and hold the forwardmost labels in the stack with precision while permitting their clean individual withdrawal by containers passing the labeling station.

Other important features and advantages of the invention will become apparent to those skilled in the art during the course of the following detailed description.

BRIEF DESCRIPTION OF THE DRAWINGS

FIG. 1 is a perspective view of a tapered can labeled in accordance with the present invention as it would normally appear on a store shelf.

FIG. 2 is a side elevation of the label on the can in FIG. 1 as it would appear if peeled off of the can.

FIG. 3 is a side elevation of a labeled tapered container according to the prior art and depicting misalignment of the label ends.

FIG. 4 is a side elevation of stacked cylindrical can bodies in accordance with the prior art.

FIG. 5 is a similar view of nested tapered can bodies in accordance with the invention.

FIG. 6 is a perspective view of a label stack pusher block forming a part of the apparatus according to the invention.

FIG. 11 is a vertical section taken on line 11—11 of FIG. 7.

FIG. 12 is an enlarged fragmentary vertical section taken on line 12—12 of FIG. 11.

FIG. 13 is an enlarged fragmentary vertical section taken on line 13—13 of FIG. 7.

FIG. 14 is a fragmentary front elevational view of the label stack and one pair of upper and lower knives.

FIGS. 15 through 19 are a series of vertical cross sections taken on lines 15—15, 16—16, 17—17, 18—18 and 19—19 of FIG. 7.

DETAILED DESCRIPTION

Figure 8:
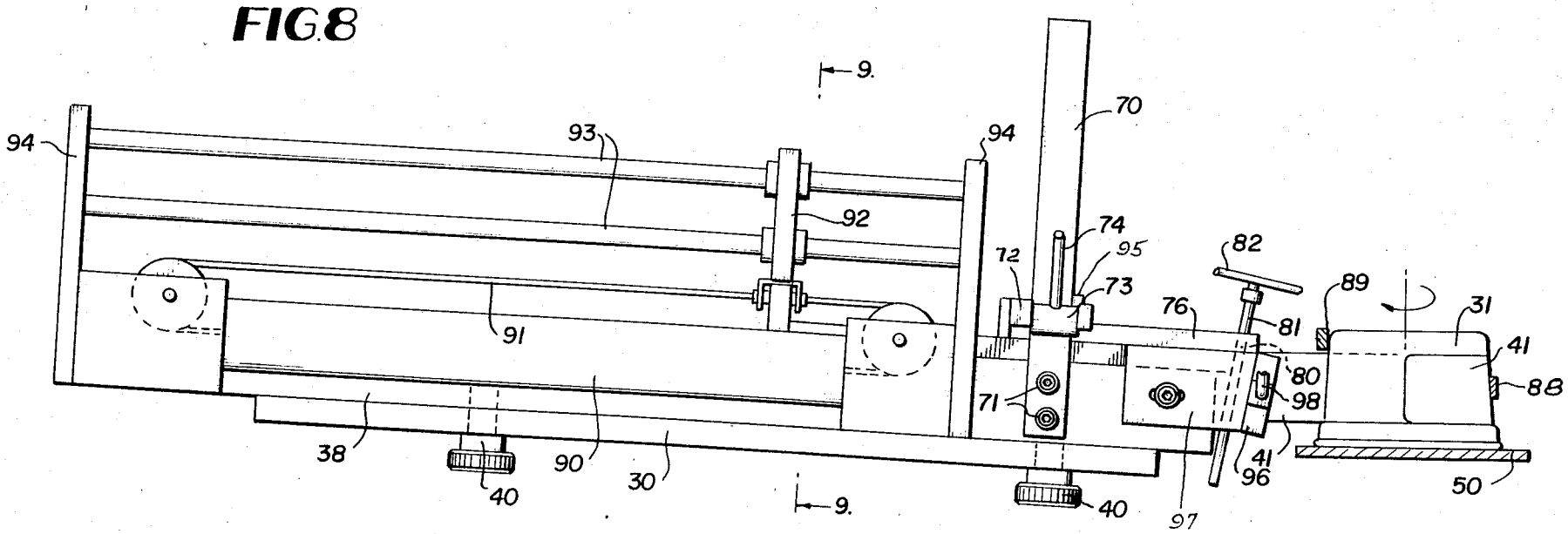
FIG. 8 is a side elevation of the apparatus shown in FIG. 7.

Referring to the drawings in detail wherein like numerals designate like parts, a tapered container labeling apparatus employed in the method of labeling according to the invention comprises a flat bed plate 30 which is normally held at a shallow angle of inclination to the horizontal, FIG. 8, by adjustable support means, not shown. The degree of inclination of the bed plate 30 during the practice of the method is dictated by the degree of taper of the cans 31 undergoing labeling. The can 31 illustrated in the drawings is a typical truncated cone can having a sufficient degree of taper to enable multiple can bodies 32 to be compactly nested, as shown in FIG. 5. This is in contrast to prior art cylindrical can bodies 33 shown in FIG. 4 which are not nestable. As best shown in FIG. 8, during the actual labeling process according to the invention, the larger diameter end of the can is disposed lowermost, which is the opposite of the normal shelf position of the can shown in FIG. 1.

Figure 7:
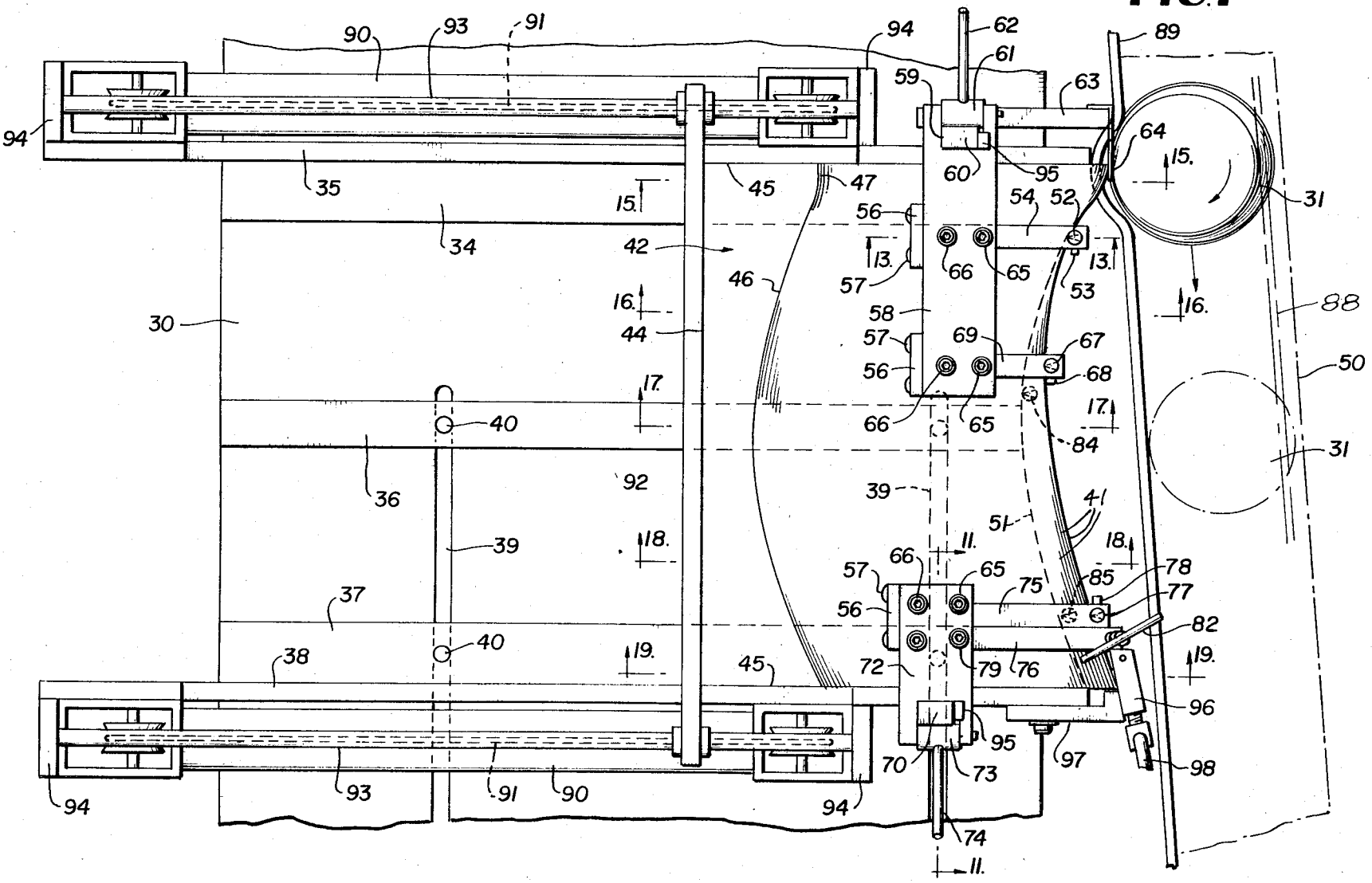
FIG. 7 is a plan view of the apparatus in association with a can conveyor.

Further concerning the drawings, it should be explained that, for ease of illustration in FIG. 7, the bed plate 30 is shown horizontal rather than inclined, as in FIG. 8, and the can 31 in FIG. 7 is slightly inclined to depict its proper relationship to the bed plate 30. In essence, FIG. 7 is slightly distorted for ease of illustration while FIG. 8 shows the true geometry of the parts.

Continuing to refer to the drawings, a fixed longitudinal guide rail 34 for labels is secured to the bed plate 30 along one side thereof and includes a vertical outer side portion 35. A parallel intermediate adjustable rail 36 is provided on the bed plate at the center of the apparatus and a parallel adjustable label guide rail 37 having an outside vertical portion 38 is similarly provided on the portion of the bed plate 30 away from the rail 34. The two rails 36 and 37 are laterally adjustable relative to the fixed rail 34 and relative to each other by means of parallel transverse adjusting slots 39 formed through the bed plate 30 which receive clamping or locking screws 40 having threaded engagement with the respective rails 36 and 37. In some cases, the center rail 36 can be fixed and only the rail 37 need be laterally adjusted. The rail adjustment feature of the apparatus allows for the accommodation of labels 41 having different lengths to accommodate different sizes of containers. As best shown in FIG. 7, during use of the apparatus, the labels 41 are provided in a thick stack measuring at least four to six inches in thickness in the front-to-back horizontal direction. The labels are stacked on edge so that their bottom edges rest slidingly on the three rails 34, 36 and 37 and their opposite ends are guidingly engaged with the vertical outer rail portions 35 and 38. It should also be noted that the center rail 36, FIG. 10, projects somewhat above the tops of the two outer rails 34 and 37 and supports the center portions of the labels 41, at a somewhat greater elevation than the end portions of the labels which rest on the rails 34 and 37. The bottom edges of the stacked labels 41 are therefore slightly bowed upwardly centrally while the top edges of the labels in the apparatus define a substantially flat common plane due to twisting and inclination of the labels, as shown in broken lines in FIG. 2A.

Figure 9:
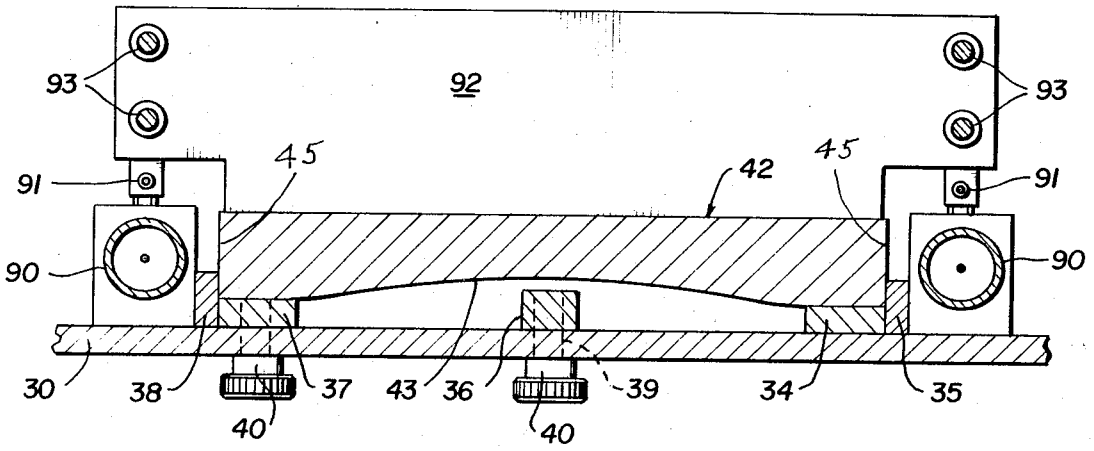
FIG. 9 is a vertical section taken on line 9—9 of FIG. 8.

Constant forward pressure is applied to the rear of the label stack by a contoured pusher block 42 whose opposite end portions ride on the rails 34 and 37, as shown in FIG. 9. The bottom of the pusher block is curved and somewhat arched upwardly between its end portions to clear the center rail 36, as indicated by the numeral 43 in FIG. 9. The back face 44 of the pusher block is vertical, as are its end faces 45 which are guided by the vertical rail portions 35 and 38. In some instances, to accommodate additional labels behind the pusher block 42, it may be desirable to contour the rear face of the block 42 in a manner similar to its front face 46.

The contoured front face 46 of the pusher block reflects the configuration of the labels 41 as they are held for application to the tapered cans in the apparatus. Cross-sectional FIGS. 15 through 19 show the varying forward inclination of the longitudinally curved front face 46 of the pusher block between its ends. One end of the front face of the pusher block indicated at 47, FIG. 15, is vertical. The far end of the front face 46 is comparatively steeply forwardly inclined as indicated at 48 in FIG. 19. Between these two end regions, the curved front face 46 undergoes a gradual transition of inclination between vertical and inclined, as depicted in FIGS. 16, 17 and 18. Furthermore, because of the bottom arch 43 of the pusher block, FIG. 9, the vertical thickness of the pusher block also varies between full thickness at the ends of the block which ride on the rails 34 and 37 and minimal thickness at the longitudinal center of the pusher block. These gradual thickness changes from full thickness to minimum thickness and back to full thickness are also reflected in FIGS. 15 through 19, the minimum center thickness being shown in FIG. 17. The illustration of labels 41 in these several figures of the drawing show that the varying inclination of the labels 41 from end-to-end follows and corresponds to the front face 46 of the pusher block.

That is to say, the labels 41 have their front faces vertically disposed adjacent to the vertical front face portion 47 of the pusher block and the other ends of the labels are forwardly inclined as at 49 in FIG. 19 in the same degree of inclination as the pusher block inclined portion 48. Between these two extremes, the labels undergo a gradual transition of forward inclination from vertical to maximum inclination. Furthermore, the curvature of the pusher block front face 46 imparts a substantially identical gradual curvature to the labels as illustrated in FIG. 7. In effect, the labels 41 are held in a twisted configuration from end-to-end in preparation for application to oncoming cans 31 on a conveyor 50 moving across the forward end of the labeling apparatus. It is this twisted configuring and holding of the labels in the invention which is quite critical to their successful application to the tapering containers 31. In all prior art arrangements, such as that of U.S. Pat. No. 3,915,338, the curved labels are held in a straight vertical plane between their ends, are not twisted, and not gradually inclined forwardly as described above, and for these reasons it has not been possible on a production basis in the prior art to consistently apply labels to tapered containers with good registration of the label ends.

Figure 2B:
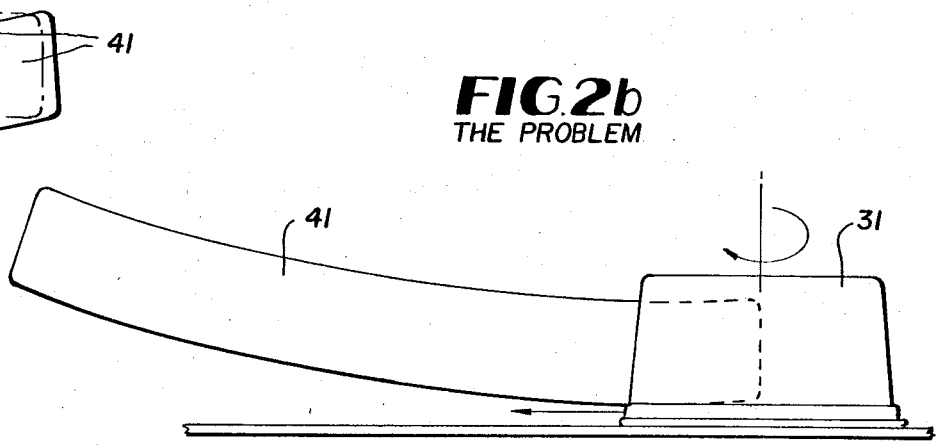
FIG. 2B is an elevational view illustrating a problem in the prior art concerning the labeling of tapered containers which the present invention solves.
Figure 2A:
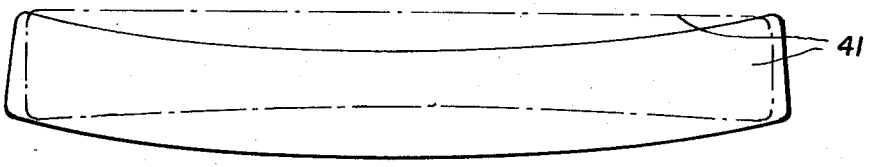
FIG. 2A is a side elevation of a label in accordance with the present invention shown in a relaxed state in full lines and in a twisted state in broken lines, as it would appear prior to application to a tapered container.

The described longitudinally twisted label configuration, in addition to being shown in the front face of pusher block 46 and by the hidden line 51 in FIG. 7, is also shown in broken lines in FIG. 2A. The twisting of the label 41 causes its top curved edge to lie in a common flat plane with the other labels of the stack as previously noted.

To achieve the necessary twisted configuration of the labels in the apparatus, the action of the pusher block 42 alone is not sufficient. In conjunction with the pusher block, a system of upper and lower knives acting on the front of the label stack close to the top and bottom edges of the labels is required to produce the necessary label shape for successful application to tapered containers. In fact, in terms of the apparatus, the system of knives, now to be described, is the most necessary and critical aspect of the improved apparatus in rendering the method of labeling, according to the invention, feasible and practical.

As shown in the drawings, the above system of knives includes knives acting on the labels near their top and bottom edges and allowing each forwardmost label in succession to be progressively separated from the stack and applied evenly to an oncoming rotating tapered container on the conveyor 50.

Figure 10:
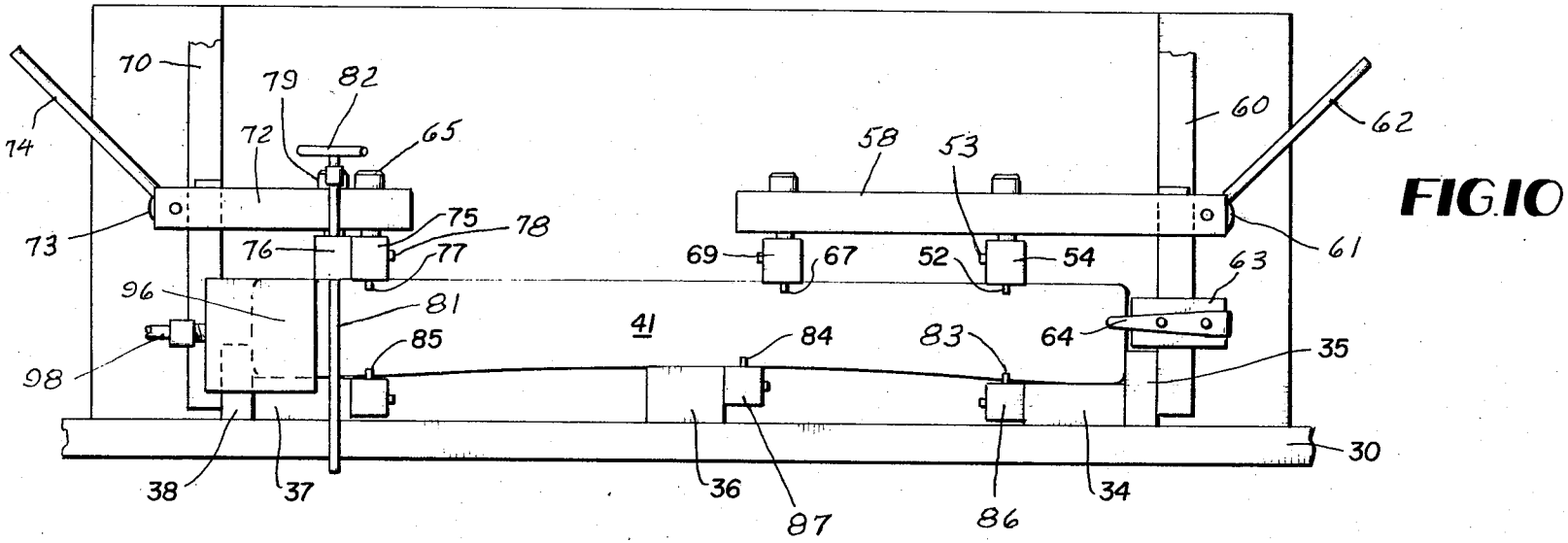
FIG. 10 is a front elevational view of the apparatus showing the arrangement of label positioning knives and associated elements.

Referring to FIG. 10, a first upper knife 52 is secured by a clamping set screw 53 to the forward end portion of an upper horizontal longitudinal bar 54 having its rear end pivotally secured at 55 to a bifurcated yoke plate 56, fixed rigidly by screws 57 to the rear side of a horizontal transverse carrier plate 58. The carrier plate 58 at its outer end is bifurcated as at 59 to receive a vertical post 60 along which the carrier plate is adjusted vertically to a required height dictated by the vertical height of the stack of labels. A quick release eccentric clamp cylinder 61 having an operating handle 62 is journaled on the bifurcated end of the carrier plate 58 and clampingly engages the outer vertical face of the post 60 to releasably lock the carrier plate 58 at the desired elevation on the post. The lower end portion of the vertical post 60 is fixed rigidly by screws to the adjacent stationary rail portion 35. A horizontal forwardly extending arm 63 fixed to the outer side of post 60 below the carrier plate 58 has a lateral spring finger 64 attached to its leading end, which spring finger slightly overlaps the leading or upstream end of the label stack close to the fixed rail portion 35.

As shown in FIG. 13, the bar 54 carrying the knife 52 can be pivotally adjusted on the axis of pivot 55 and locked in the required position by means of an adjusting screw 65 on the carrier plate 58 and a coacting locking set screw 66 on such plate. A second upper knife 67 is similarly secured by a set screw 68 to a horizontal longitudinal bar 69, parallel to the bar 54 but spaced laterally inwardly thereof to a point near and spaced from one side of the center rail 36, FIG. 14. The bar 69 carrying the upper knife 67 is adjustably held on the carrier plate 58 in exactly the same manner described for the bar 54 carrying the upper knife 52 and therefore the mounting arrangement for the bar 69 need not be described in detail. As best shown in FIG. 7, the upper knife 67 is held somewhat rearwardly of the upper knife 52. Both knives 52 and 67 can be raised and lowered with the carrier plate 58, as described, and the bars 54 and 69 can both be pivoted and locked in the manner shown and described relative to FIG. 13 of the drawings.

On the far or downstream end of the label stack in relation to the conveyor 50, another vertical post 70 similar to the post 60 is fixed by bolts 71 to the adjacent laterally adjustable rail portion 38. A horizontal transverse carrier plate 72, similar to the carrier plate 58, but somewhat shorter than the latter, is provided. This carrier plate is adjustable vertically and is lockable at the required height on the post 70 by the identical means previously described for adjusting and locking the carrier plate 58, including an eccentric manually operated quick release clamp cylinder 73 having a handle 74. The carrier plate 72 carries two side-by-side horizontal longitudinal parallel bars 75 and 76 at the same elevation. Near its forward end, the bar 75 carries a third upper knife 77 secured by a set screw 78. The bar 75 is pivotally adjustable upwardly and downwardly on the carrier plate 72 by the identical means shown and described in connection with FIG. 13 for the bar 54. The bar 76 is fixed rigidly on the carrier plate 72 by screws 79. As shown in FIG. 7 the upper knife 77 is located near the downstream side of the label stack and is also located somewhat forwardly of the other two upper knives 67 and 52. As indicated in FIG. 13, the upper knives extend only a small distance below the top edges of the labels 41.

The bar 76 near its leading end has an inclined opening 80 which receives therethrough a cylindrical label curling rod 81, preferably having a handle 82. The angle of inclination of the curling rod, FIG. 8, matches and is parallel to the steepest inclination of the labels near their downstream ends indicated by the numeral 49 in FIG. 19. As each forward label 41 is withdrawn from the stack during its application to a container 31, its downstream or trailing end is pulled across the rear side of the curling rod 81 and has a curl imparted thereto which assists the trailing end of the label in properly adhering to the exterior surface of the forward end of the label which it slightly overlaps, as shown in FIG. 1.

The system of knives includes three lower knives 83, 84 and 85, which knives project slightly above the bottom edge of each forward label 41 in the stack. The lower knife 83 is aligned vertically with the upper knife 52, but the intermediate knife 84 is spaced somewhat laterally downstream from the intermediate knife 67 and is also spaced rearwardly thereof, as shown in FIG. 7. The third lower knife 85 is very slightly upstream from the upper knife 77 in relation to the conveyor 50 and is also spaced rearwardly of the knife 77 with reference to the label stack. The described critical placement and spacing of the upper and lower knives is paramount in imparting to each forward label 41 the required twist between its upstream and downstream ends for successful application to tapered containers.

The lower knife 83 is secured by a set screw to a horizontal holding bar 86, FIG. 13, which bar is fixed by screws to the bed plate 30. The intermediate lower knife 84 is similarly fixed to a holding bar 87, fixedly secured to one side of the center rail 36 and being flush with the top face of the rail 36, FIG. 14. This places the knife 84 at an elevation somewhat above the two lower knives 83 and 85 which are at the same elevation. The elevated knife 84 therefore is positioned to properly engage the somewhat arched lower edge of each twisted label. The three top knives are substantially at one elevation. All of the knives can be adjusted with precision to properly configure the labels for ready application to the oncoming tapered containers in accordance with the objective of the invention.

The conveyor 50 is driven by conventional means. The outer side of each container, FIG. 8, adjacent to the label 41, is engaged by a driven belt 88 which imparts rotation to the containers in the direction of the arrow. The other side of each container nearest the label stack rollingly engages a straight guide track 89 in accordance with conventional practice.

Constant pressure is exerted on the rear side of label pusher block 42 by a quick return pneumatic cylinder arrangement including two parallel cylinders 90 whose pistons operate drive cables 91, connected with a transverse drive plate 92 which engages the rear vertical face 44 of pusher block 42. The drive plate 92 is engaged with parallel pairs of guide rods 93 secured to posts 94 at their opposite ends.

To assure precision operation of the carrier plates 58 and 72 on the posts 60 and 70, each carrier plate is equipped with an adjustable bearing 95 of brass or the like.

A means to apply glue to the downstream end portion of the forward face of each label 41 is provided. This means comprises an apertured glue applicator block 96 held by a mounting bracket 97 on the forward end of adjacent vertical rail portion 38. The applicator block 96 receives glue through an attached conduit 98 from a suitable source not shown. The rear face of the block 96 overlaps the downstream end of the label stack and exudes through apertures in the block a small quantity of glue onto the adjacent end portion of each label, whereby such end portion will become adhered to the upstream end portion of the label when label application is complete, FIG. 1.

OPERATION

Each rotating container 31 on the conveyor 50 having its larger end lowermost receives glue on its periphery by conventional means, not shown, upstream from the labeling station. Each container bearing glue makes contact through its tapered side wall with the upstream end of the forwardmost label 41 in the stack and begins the withdrawal of the forward label from the stack, the spring finger 64 yielding to permit the label to be separated from the stack. Instantly the label begins to be wrapped onto the tapered container side wall due to rotation and linear movement of the container with the conveyor 50. Since the system of upper and lower knives, previously described, in conjunction with the contoured pusher block 42, is maintaining the labels in a twisted and gradually inclined configuration, as described in detail, each withdrawn forward label will be progressively separated from the front of the stack, beginning at its upstream end, until the label is completely wound upon the container tapered side wall. The described placement of the upper and lower knives regulates or controls the separation of the label from the stack, and is the main factor in assuring that the top and bottom edges of the label are in true parallelism to the top and bottom end faces of the tapered container, and that the two end portions of the label overlap in good registration in accordance with the objective of the invention. As each label 41 is gradually separated from the front of the label stack, the sharp upper and lower knives merely nick the edges of the label in a manner that does not deface the label.

With the described apparatus in proper adjustment and containing an adequate supply of labels, the labels can be rapidly applied to tapered cans and the like on a production basis with uniformity to meet the stringent standards of the industry. The apparatus and the method according to the invention are simple, practical and economical. The described drawbacks of the prior art are essentially eliminated.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A method of labeling conically tapered containers comprising transporting the containers in succession along a linear path while rotating them in one direction on their cone axes, applying glue to the conically tapered peripheries of the containers during their transport, positioning labels in a stack on edge adjacent to one side of the linear movement path of the containers, configuring the labels in the stack so that at least the forwardmost label is twisted between its upstream and downstream ends with its upstream end substantially vertically disposed and its downstream end forwardly inclined from bottom-to-top and with the inclination of the label progressively increasing from its upstream to its downstream end, and engaging the glued periphery of each container with the upstream end of the forwardmost label in the stack and progressively withdrawing the forwardmost label from the stack between its upstream and downstream ends and during such withdrawal wrapping the label around and adhering it to the tapered periphery with the ends of the label in substantial alignment following application to the container.

2. The method of claim 1, wherein the containers being transported and rotated are truncated conical containers having their cone axes vertically arranged and having their larger ends disposed lowermost, and the labels positioned in the stack on edge being longitudinally arcuate and having their longer longitudinal edges arranged lowermost.

3. The method of claim 1, and further configuring the labels in the stack so that their lower edges are somewhat bowed upwardly near the transverse center of the stack and the top edges of the labels in the stack define substantially a flat plane.

4. The method of claim 3, and further configuring the labels in the stack so that the center portions of the labels between their upstream and downstream ends are bowed inwardly and rearwardly toward the rear of the stack with relation to one side of said linear transport path.

5. The method of claim 1, and the configuring of the labels comprising engaging the labels at the front of the stack near their top and bottom edges by a system of depending and upstanding knives in spaced relationship to each other and to the upstream and downstream ends of the labels.

6. A tapered container labeling apparatus comprising a bed plate, fixed and adjustable parallel spaced label guide rails on the bed plate, a contoured label stack pusher block engaged with said guide rails, a substantially constant pressure label stack feed means engaged with the rear of the pusher block, an on-edge stack of labels having their lower edges engaged with said rails and the rear of said stack being engaged with a forward contoured face of said pusher block, a system of upper and lower laterally spaced knives on the bed plate adapted to engage the forward labels in the stack at laterally spaced points along and near their upper and lower edges to impart to the labels a longitudinally twisted configuration between their upstream and downstream ends and a progressively forwardly inclined disposition between their upstream and downstream ends, means to convey upwardly tapering and rotating containers horizontally in succession across the front of the stack of labels with glue applied to the tapered peripheries of the containers whereby the tapered peripheries of the containers can engage the upstream ends of labels and separate them from the front of the stack while winding them around the tapered peripheries, and means to apply glue to the downstream end forward faces of labels in said stack whereby the downstream ends can adhere to the upstream ends of labels applied to said tapered peripheries.

7. A tapered container labeling apparatus as defined in claim 6, and vertically adjustable support means for the upper knives of said system on the bed plate whereby the apparatus can process labels of varying heights.

8. A tapered container labeling apparatus as defined in claim 7, and adjusting means on said support means operable to raise and lower certain of the upper knives in said system relative to the top of the label stack.

9. A tapered container labeling apparatus as defined in claim 8, and an inclined label curling rod on the support means near the downstream end of the labels to impart a curl to the downstream end portion of each label being separated from the front of the stack and being applied to a container.

10. A tapered container labeling apparatus as defined in claim 7, and quick release clamping means for said vertically adjustable support means, said support means including a pair of upright posts rising from the bed plate and a pair of substantially horizontal knife carriage plates guidingly engaged with the posts.

11. A tapered container labeling apparatus as defined in claim 6, and said label guide rails including one fixed side rail, one laterally adjustable and lockable side rail, and one intermediate rail, the top face of the intermediate rail projecting somewhat above the top faces of the side rails whereby end portions of stacked labels can rest on the side rails at one elevation and central portions of the labels can rest on the top face of the intermediate rail at a greater elevation.

12. A tapered container labeling apparatus as defined in claim 11, and the two side rails having vertical portions adapted to engage and guide the upstream and downstream ends of stacked labels.

13. A tapered container labeling apparatus comprising supporting and pushing means for an on-edge stack of labels to be applied to upwardly conically tapering peripheries of rotating containers on a conveyor extending across the longitudinal axis of said supporting and pushing means, and a system of adjustable upper and lower label holding and configuring knives on the holding and pushing means operable to impart a twisted configuration to the labels between their upstream and downstream ends with the labels being substantially vertically held at their upstream ends and being progressively inclined forwardly between their upstream and downstream ends so that the downstream ends are forwardly inclined substantially in relation to the upstream ends, means to apply glue to the forward faces of the downstream ends of labels in said stack and conveyor means for rotating upwardly conically tapering containers extending across the front of the supporting and pushing means and the front of said stack of labels.

* * * * *